US006320303B1

(12) United States Patent
Noji et al.

(10) Patent No.: US 6,320,303 B1
(45) Date of Patent: Nov. 20, 2001

(54) RADIOACTIVE-RAY IMAGE TUBE HAVING INPUT MEMBER FORMED OF A CLAD MATERIAL

(75) Inventors: Takashi Noji, Tochigi-Ken; Mitsumasa Hiroi; Junji Taniguchi, both of Yokohama; Yoshinobu Sekijima, Otawara, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/196,140

(22) Filed: Nov. 20, 1998

(30) Foreign Application Priority Data

Nov. 21, 1997 (JP) ..... 9-321618
Oct. 26, 1998 (JP) ..... 10-304543

(51) Int. Cl.[7] ..... H01J 31/00; H01J 31/26; H01J 40/00; H01J 40/16

(52) U.S. Cl. ..... 313/365; 373/527; 373/541; 250/214 VT

(58) Field of Search ..... 313/365, 373, 313/375, 523, 525, 526, 527, 530, 541, 542, 544; 250/214 VT, 483.1

(56) References Cited

U.S. PATENT DOCUMENTS 4,045,699 * 8/1977 Gunther ..... 313/59
4,195,230 3/1980 Ataka et al. .
4,331,898 * 5/1982 Shimizu et al. ..... 313/59
4,721,884 * 1/1988 Colomb et al. ..... 313/525
4,855,587 8/1989 Creusen et al. .
4,870,473 9/1989 Sugimori .
5,506,403 4/1996 Yamada et al. .
5,646,477 * 7/1997 Yamagishi ..... 313/365
5,694,673 12/1997 Yamada et al. .

FOREIGN PATENT DOCUMENTS 0 563 903 10/1993 (EP) .
0 644 572 3/1995 (EP) .
59-75544 4/1984 (JP) .

* cited by examiner

*Primary Examiner*—Nimeshkumar D. Patel
*Assistant Examiner*—Karabi Guharay
(74) *Attorney, Agent, or Firm*—Oblon, Spivak, McClelland, Maier & Neustadt, P.C.

(57) ABSTRACT

The object of the present invention is to provide a radioactive-ray image tube having less deformations, such as the twist of an input substrate, less aberration over the entire regions of an output image, excellent resolution and good brightness uniformity and contrast characteristics. This radioactive-ray image tube 1*a* comprises an input window 10 formed on one side surface of a vacuum vessel 2*a* and allowing radioactive-rays to enter the vacuum vessel 2*a*, an input screen 5 for converting the radioactive-rays incident on the input window 10 into a fluorescent image or a photoelectric image, and an input substrate 4*a* holding the input screen 5, is characterized in that the input substrate 4*a* comprises of a clad material 13 having an aluminum alloy material 11 on the radioactive-ray incidence side and a pure aluminum material 12 on the input screen 5 side provided integrally with each other.

12 Claims, 12 Drawing Sheets

IRREGULARITY PROFILE OF THE PURE ALUMINUM MATERIAL SURFACE OF THE INPUT SUBSTRATE COMPRISING THE CLAD MATERIAL (PRIOR TO BENDING PROCESSING)

IRREGULARITY PROFILE OF THE PURE ALUMINUM MATERIAL SURFACE OF THE INPUT SUBSTRATE COMPRISING THE CLAD MATERIAL (AFTER ETCHING PROCESSING)

IRREGULARITY PROFILE OF THE PURE ALUMINUM MATERIAL SURFACE OF THE INPUT SUBSTRATE COMPRISING THE CLAD MATERIAL (AFTER BURNISHING PROCESSING)

IRREGULARITY PROFILE OF THE INPUT SUBSTRATE SURFACE COMPRISING ALUMINUM ALLOY (AFTER BURNISHING PROCESSING)

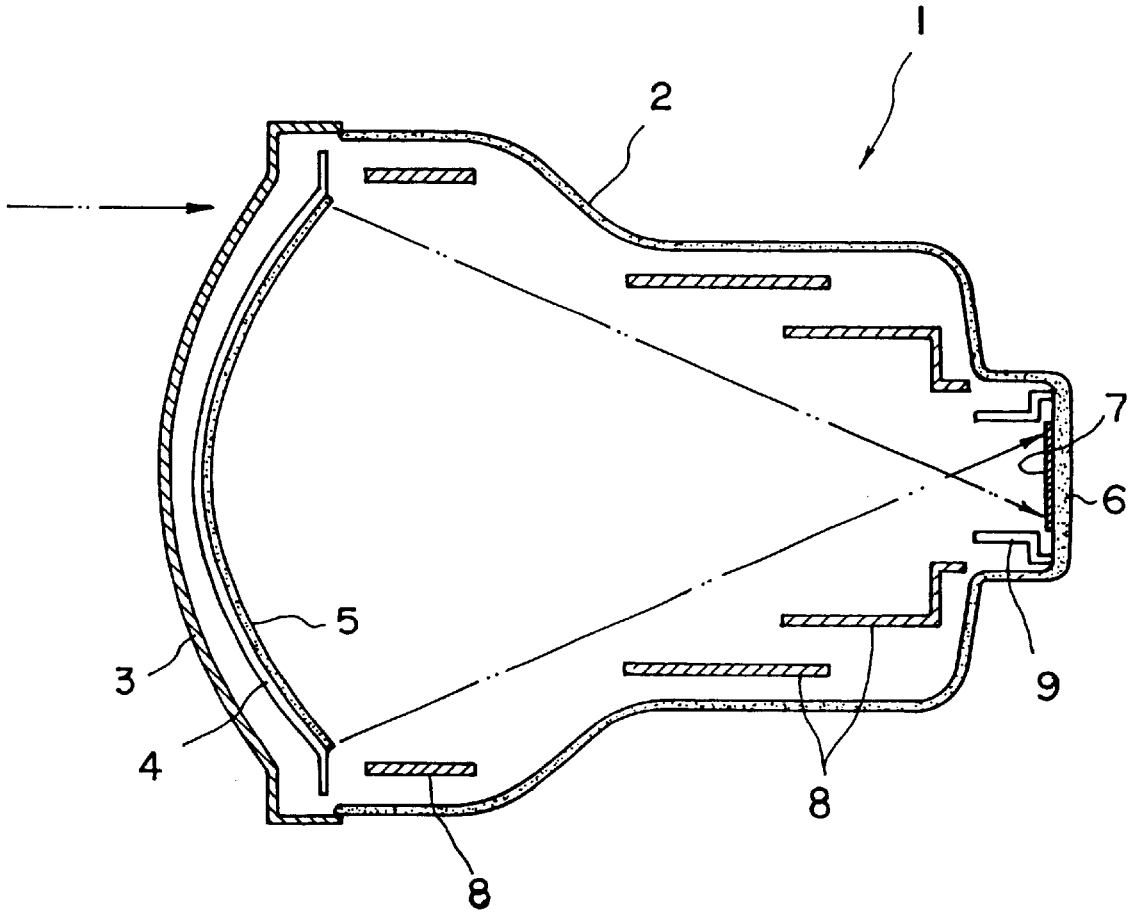
PRIOR ART FIG. 18

RADIOACTIVE-RAY IMAGE TUBE HAVING INPUT MEMBER FORMED OF A CLAD MATERIAL

BACKGROUND OF THE INVENTION

1. Field of the Invention

The present invention relates to a radioactive-ray image tube for converting a radioactive-ray image into a visible image or an electric image signal, and relates to a manufacturing method thereof. More particularly, the present invention relate to a radioactive-ray image tube capable of preventing the scattering of radioactive rays, particularly, at an input part to improve efficiency in use of radioactive rays, achieving high contrast and high resolution and obtaining a high quality photofluorographic output image as well as a manufacturing method thereof.

Radioactive rays for input part excitation to which the present invention is applicable are ones in a broader sense, including, for example, X rays, α rays, β rays, γ rays, neutron rays, electron rays and highly charged particle rays.

2. Description of the Related Art

Description will be given to a conventional radioactive-ray image tube, taking a typical X ray image intensifier tube using X rays as radioactive ray as an example. The X ray image tube is installed, as main equipment for examining the internal configuration of a human body or a structure, into an X ray diagnostic apparatus or a nondestructive testing apparatus. The X ray image tube is used to convert the radioactive-ray image of a radioactive-ray transmittance system for examining the transmittance distribution of X rays penetrating through a human body or a structure, into a visible image or an electric image signal.

FIG. 18 is a cross-sectional view showing the schematic structure of a conventional X ray image intensifier tube 1. The X ray image tube 1 comprises a vacuum vessel 2, an X-ray input window 3 formed on one side surface of the vacuum vessel 2 and comprising of Al material curved into a convex shape externally, an input substrate 4 arranged inside the input window 3 to leave a predetermined distance from the window 3, an input screen 5 comprising an input phosphor layer such as CsI layer and a photocathode layer formed on the inner surface of the input substrate 4, an output window 6 formed on the other side surface of the vacuum vessel 2 so as to oppose the input screen 5 and an output screen 7, such as a phosphor layer for observation, formed on the inner surface of the output window 6. Between the input window 3 and the output window 6 are coaxially provided with focusing electrodes 8 and anode 9 in appropriate numbers for the formation of an electrostatic lens system.

An aluminum alloy plate such as A6061P-O material specified by JIS (Japanese Industrial Standard) generally having a thickness of about 0.5 to 3.2 mm, a titanium plate having a thickness of about 0.2 to 0.4 mm or a stainless steel plate have been used as the material of the input window 3. They are selected because it is necessary to have good X ray transmittance characteristics and for the vacuum vessel 2 to sufficiently mechanically withstand external pressure such as atmospheric pressure.

In addition, the input window 3 tends to be easily deformed internally by the external pressure before and after evacuation. Due to this, if the input screen 5 is formed directly inside the input window 3, an output image tends to be distorted. To avoid the influence of the deformation of the input window 3, the input screen 5 is formed on the input substrate 4 which has been separately formed from the input window 3 and arranged to have a distance of, for example, about 10 to 15 mm, from the input window 3.

The above input substrate 4 comprises of a soft pure aluminum material which can be easily smoothed to enhance the adhesion strength (bonding strength) of the input screen 5 and to suppress the irregular reflection of emission light on the surface of the input substrate 4.

In the X ray image tube 1, X ray transmitted through the input window 3 and input substrate 4 is converted into phosphor image by the input screen 5 and further into corresponding photoelectric images by photocathode layer. The photo electrons are accelerated and converged by the electrostatic lens system comprising of the focusing electrodes 8 and anode 9, then the electrons are collided with the output screen 7, thereby obtaining an optical image or electrical image signals.

In the conventional X ray image tube stated above, however, the input substrate is made of soft pure aluminum material. Due to this, to accurately hold the input screen such as a phosphor layer at a predetermined position while maintaining high structural strength, it is necessary to form the input substrate out of a considerably thick material. As a result, the absorption of X rays at the input substrate increase and X rays scatter more greatly, thereby disadvantageously lowering the resolution of the X ray image tube.

Besides, in the conventional X ray image tube, the X ray input part is formed of a double structure comprising of an input window and an input substrate arranged to have a predetermined distance from the input window. Due to this structure, the following disadvantages occur. The absorption and scattering of incident X rays increase at the input part. Efficiency in use of X rays decreases. The brightness, contrast characteristics and resolution of a finally obtained output image greatly deteriorate.

Moreover, since the conventional X ray image tube has a structure in which the input window and the input substrate are separately fabricated and assembled, complex steps are required to manufacture and assemble the X ray image tube and X ray image tube production costs thereby increase.

Meanwhile, to prevent X rays from scattering at the input part, an X ray image tube having an input screen directly formed on the inner surface of the input window has been manufactured. However, this structure has a disadvantage in that plane quality on the inner surface of the input window tends to be non-uniform and coarse, the input phosphor layer such as a CsI deposited film tends to be non-uniform and influenced by distortion, resulting in the aggravated resolution of an output image.

SUMMARY OF THE INVENTION

The present invention has been made to overcome the above-stated disadvantages. It is, in particular, an object of the present invention to provide a radioactive-ray image tube capable of preventing radioactive rays from scattering at, above all, the input part to thereby enhance efficiency in using radioactive rays, obtaining higher brightness characteristics, contrast characteristics and resolution, improving the uniformity of these characteristics to thereby re-configure high image quality radioactive rays, which tube is relatively easy to manufacture, as well as a radioactive-ray image tube manufacturing method.

A radioactive-ray image tube according to the present invention is characterized in that an input substrate having an input screen attached onto one side thereof comprises of a clad material having an aluminum alloy material on the radioactive-rays incidence side and a pure aluminum material on the side onto which the input screen is attached.

A radioactive-ray image tube manufacturing method according to the present invention is characterized by comprising the steps of: conducting annealing processing for a predetermined period of time after crimping the aluminum alloy material and the pure aluminum material and then forming the input substrate comprising of the clad material integrated by rolling; attaching the input screen onto a surface on the pure aluminum material side of the input substrate; and installing the obtained input substrate on a radioactive-rays incidence side of the vacuum vessel.

As the input substrate comprising of the clad material and having the input screen attached onto the surface of the pure aluminum material, it is preferable to use an expanded material such that the aluminum alloy material has an aluminum content of less than 99% by weight and a proof stress of not less than 4 $kg/mm^2$ and the pure aluminum material thereof has an aluminum content of not less than 99% by weight and a proof stress of not more than 3 $kg/mm^2$.

If the input substrate is arranged in a state in which the atmospheric pressure is not directly applied to the interior of the vacuum vessel of the radioactive-ray image tube, then the strength of the input substrate does not have to be very high and therefore the input substrate can be made thinner. By making the input substrate as thin as possible, it is possible to reduce the absorption and scattering of radioactive rays at the input substrate and to thereby further improve the resolution of the image tube. In addition, this facilitates processing the inner surface of the input substrate serving substantially as a cathode of the electron lens system into an optimum shape and dimensions.

Meanwhile, it is requisite for the radioactive-ray image tube having a structure in which the input substrate also serves as the radioactive-rays incidence window of the vacuum vessel, that the input substrate sufficiently withstands the atmospheric pressure, can be easily formed into a concave curved shape and is not easily deformed such that the input screen directly attached onto the inner surface of the input substrate serves as the cathode of the electron lens system. As a material for such an input substrate which also serves as the incidence window, the clad material wherein a high strength aluminum alloy material and a pure aluminum material are provided integrally with each other is appropriate.

The aluminum alloy material constituting the clad material on one surface side may be preferably, for example, A#3000 type: aluminum alloy (Al—Mn alloy), A#4000 type: aluminum alloy (Al—Si alloy), A#5000 type: aluminum alloy (Al—Mg alloy) or A#6000 type: aluminum alloy (Al—Mg—Si alloy, Al—$Mg_2Si$ alloy) each specified by JIS (Japanese Industrial Standard H4000-1988). The pure aluminum material on the other side may be preferably, for example, A#1000 type: aluminum material (purity of 99.0% or more) specified by JIS H4000.

The entire thickness of the clad material constituting the input substrate is preferably in a range of 0.2 to 2.0 mm if installed in a state in which no atmospheric pressure is applied. If the input substrate serving as the input window is installed in a state in which the atmospheric pressure is applied, the thickness of the clad material is preferably in a range of 0.5 to 3.0 mm in a practical sense.

The ratio of the thickness of the aluminum alloy material to that of the pure aluminum material, both constituting the clad material, is preferably in a range of 1:2 to 80:1.

To obtain high resolution and high conversion efficiency, the phosphor layer of the input screen is made of a phosphor such as cesium iodide (CsI) activated by sodium (Na). To obtain high resolution and high conversion efficiency, the phosphor layer is formed by the vacuum evaporation method to provide a structure of fine columnar crystals each having a thickness of about 400 $\mu$m or more.

Among the materials for constituting the clad material which becomes the input substrate serving as the input window, the aluminum alloy material arranged on the radioactive-rays incidence side is used, as part of the vacuum vessel, for the necessity of having structural strength to withstand the atmospheric pressure. For example, A#3000 type: Al—Mn alloy, A#4000 type: Al—Si alloy, A#5000 type: Al—Mg alloy, and A#6000 type: Al—Mg—Si alloy, Al—$Mg_2Si$ alloy specified by JIS H4000-1988 may be appropriately used.

The A#3000 type alloys involve, for example, an alloy including Si of not more than 0.6% by weight, Fe of not more than 0.8% by weight, Cu of not more than 0.30% by weight, Mn of not more than 1.5% by weight, Mg of not more than 1.3% by weight, Cr of not more than 0.20% by weight, Zn of not more than 0.40% by weight, an inevitable impurity element of not more than 0.15% by weight and Al of a remaining % of weight.

The A#5000 type alloys involve, for example, an alloy including Si of not more than 0.4% by weight, Fe of not more than 0.7% by weight, Cu of not more than 0.2% by weight, Mn of not more than 1.0% by weight, Mg of not more than 5.0% by weight, Cr of not more than 0.35% by weight, Zn of not more than 0.25% by weight, an inevitable impurity element of not more than 0.15% by weight and Al of a remaining % of weight.

The A#6000 type alloys involves, for example, an alloy including Si of 0.4 to 0.8% by weight, Fe of not more than 0.7% by weight, Cu of 0.15 to 0.40% by weight, Mn of not more than 0.15% by weight, Mg of 0.8 to 1.2% by weight, Cr of 0.40 to 0.35% by weight, Zn of not more than 0.25% by weight, an inevitable impurity element of not more than 0.15% by weight and Al of a remaining % of weight.

Among these aluminum alloys, for example, JIS-6061 aluminum alloy, one of Al—Si—Mg alloy materials, is particularly suited. This alloy is an aluminum alloy including Mg of about 1.0% by weight, Si of about 0.6% by weight, Cu of about 0.25% by weight and Cr of about 0.25% by weight. An expanded material with material identification symbol "O", i.e., annealed and rolled into a thickness of about 0.5 mm is mainly used in the embodiments to be described hereinafter. Needless to say, such an aluminum alloy material can be also used for one of constituent materials of the input substrate arranged within the vacuum vessel in a state in which no atmospheric pressure is applied.

A#2000 type Al—Cu alloy and A#7000 type Al—Zn alloy specified by JIS lack structural strength and are, therefore, not suitable for the aluminum alloy material for constituting the input substrate which also serves as the input window.

On the other hand, the pure aluminum material as the other material for constituting the clad material is used to form a phosphor layer having a uniform and good plane shape. A soft pure aluminum material capable of forming a uniform plane shape is, in particular, used for this purpose. Such soft pure aluminum materials involve, for example, A#1000 type aluminum plate (purity of 99.0% or more), more particularly, A1050P material (purity of 99.5% or more) specified by JIS H4000-1988. The A#1000 type alloy components involve, for example, an aluminum material including Si of not more than 0.25%, Fe of not more than 0.4%, Cr of not more than 0.05%, Mn of not more than 0.05%, Mg of not more than 0.05%, Zn of not more than 0.10%, an inevitable impurity element of not more than 0.15% and Al of the remaining % by weight.

If the thickness of the clad material constituting the input substrate which also serves as the input window of the vacuum vessel is less than 0.5 mm, the compressive strength (pressure resistance) is not sufficient for the vacuum vessel. If the thickness exceeds 3.0 mm, the transmittance loss and scattering of radioactive rays increase, thus making it difficult to obtain a high image quality transmitted image having high contrast characteristics and resolution. Accordingly, the overall thickness of the clad material for constituting the input substrate which also serves as the input window of the vacuum vessel is set to fall within a range of 0.5 to 3.0 mm.

If the input substrate does not serve as the input window of the vacuum vessel, no atmospheric pressure is applied. It is therefore enough to have a minimum of mechanical strength as required. In practice, the thickness may be 0.2 mm to 2.0 mm.

If the ratio of the thickness of the high strength aluminum alloy material to that of the pure aluminum material, both constituting the clad material, is less than 1:2, then the compressive strength of the clad material is insufficient, that is, the clad material is easily deformed under the atmospheric pressure and the transmitted image is easily distorted. If the thickness ratio exceeds 80:1 or the thickness of the pure aluminum material becomes overly small, then it is difficult to maintain uniform plane quality and the phosphor layer comprising of the CsI deposited film is affected by the coarse surface, thereby to deteriorate the resolution of the transmitted image. Accordingly, the ratio of the thickness of the high strength aluminum alloy material to that of the pure aluminum material is set to fall within a range of 1:2 to 80:1.

Moreover, in the radioactive-ray image tube manufacturing method, after the step of curving the clad material and forming the input substrate, the step of burnishing the surface on the pure aluminum material side of the input substrate to thereby crush minute irregularities of the surface and smooth the surface may be provided. By conducting this burnishing processing, minute irregularities such as irregularities generated during the formation of the clad material and rolling lines are removed and the concave curved surface of the input substrate is smoothed, so that adhesive strength (bonding strength) of the phosphor layer against the input substrate is greatly improved and, at the same time, the scattering of radioactive rays on the surface of the input substrate is suppressed and the resolution of the radioactive-ray image tube is greatly improved.

An alkali halide phosphor film and a photocathode layer may be integrally attached onto the inner surface of the input window on which radioactive rays are incident.

In the radioactive-ray image tube having the above-stated structure, the input substrate is formed out of the clad material comprising of the high strength aluminum alloy material and the good plane quality pure aluminum material. Due to this structure, compared with the conventional input substrate consisting only of the pure aluminum material, the thickness of the input substrate can be lessened to a minimum of about 0.2 to 0.3 mm as required. The absorption of radioactive rays at the input substrate can be, therefore, suppressed effectively and the resolution of the image tube can be enhanced.

If the input substrate is formed to also serve as the X ray input window, the scattering and transmittance loss of radioactive rays at the input part are small. This is because the input window comprises of the clad material having the high strength aluminum alloy material and the soft pure aluminum material provided integrally with each other, that is cladding. As a result, efficiency in use of radioactive rays can be enhanced and a transmitted image having high contrast characteristics and high resolution can be obtained.

Moreover, since the phosphor layer is formed on the inner surface of the soft, good plane quality pure aluminum material, the phosphor layer can be formed into a uniform and smooth layer, as well, thereby making it possible to reduce noise and to greatly improve the resolution of the image. That is, since the inner surface of the input substrate, onto which the input phosphor surface (phosphor layer) is directly attached, comprises of pure aluminum, minute irregularities on the inner surface can be easily crushed and smoothed by burnishing processing in which a large number of metal or ceramic micro-balls each having a diameter of about 1 mm are put and rotated in the interior.

Furthermore, if the input substrate is formed to serve as the input window, a single sheet of the clad material can function as both the input window and the input substrate, which have been conventionally manufactured separately and assembled. The number of parts can be reduced to thereby simplify manufacturing and assembly steps, thus making it possible to greatly decrease manufacturing costs of the radioactive-ray image tubes.

BRIEF DESCRIPTION OF THE DRAWINGS

FIG. 18 is a cross-sectional view showing the schematic structure of the conventional X ray image intensifier tube.

DETAILED DESCRIPTION OF THE PREFERRED EMBODIMENTS

Embodiments of the present invention will now be described in more detail with reference to the accompanying drawings.

Figure 1:
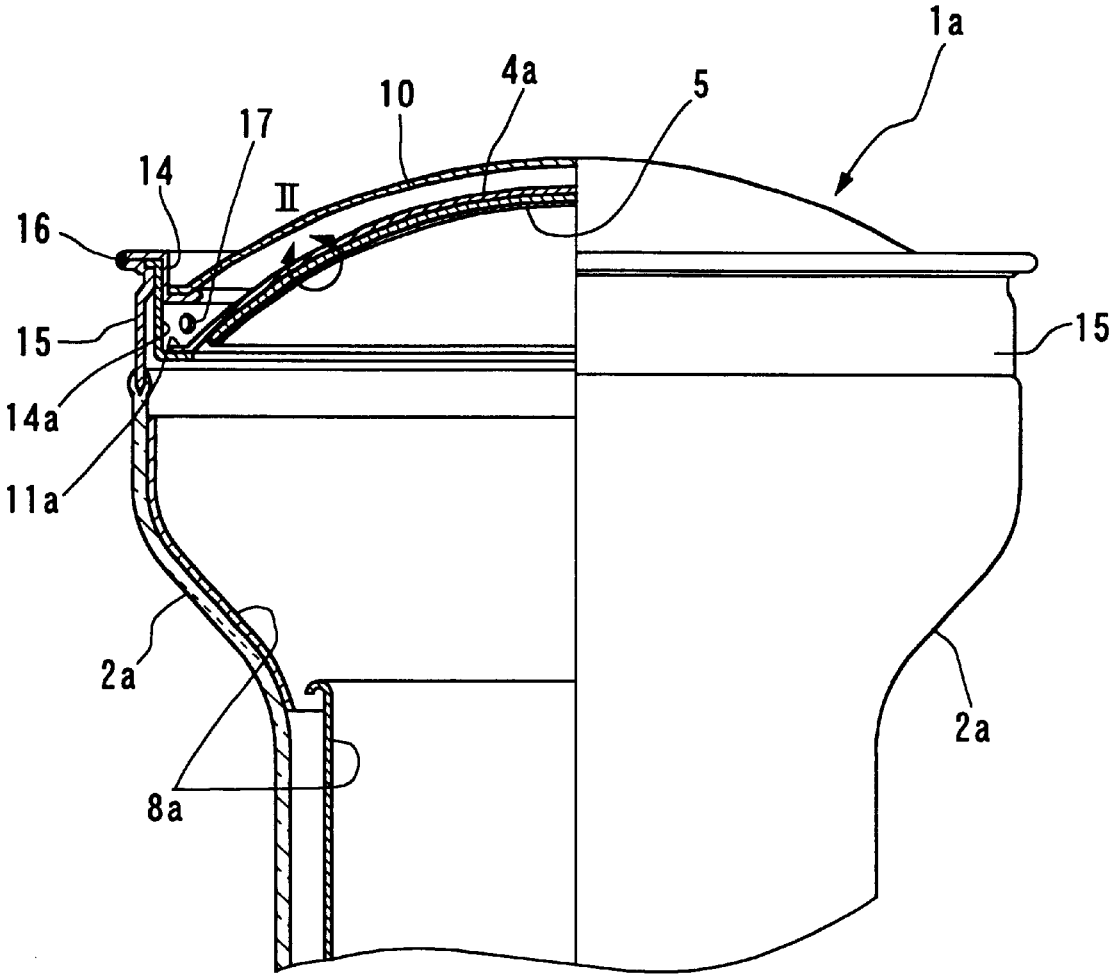
FIG. 1 is a cross-sectional view showing an embodiment of a radioactive-ray image tube according to the present invention.
Figure 2:
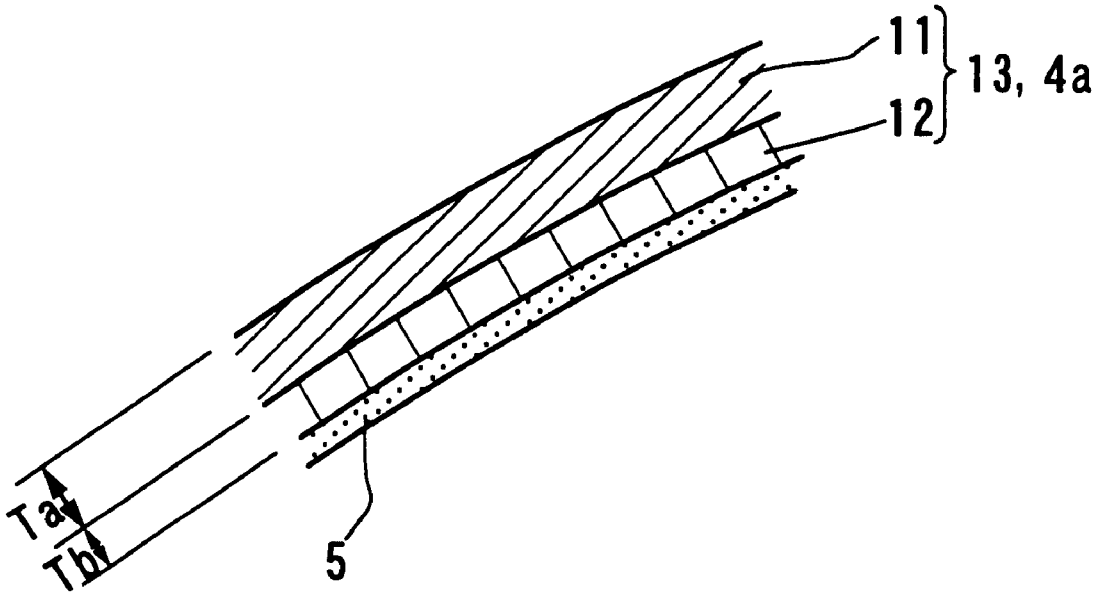
FIG. 2 is an enlarged cross-sectional view showing a part II of FIG. 1.

FIGS. 1 and 2 are cross-sectional views showing an embodiment wherein a radioactive-ray image tube according to the present invention is applied to an X ray image intensifier tube 1*a*. Namely, the X ray image tube 1*a* in this embodiment is comprised of an input window 10, mounted on one side of a vacuum vessel 2*a*, on which an X ray is incident and passes through it, an input screen 5 for converting the X ray incident on the input window 10 into a fluorescent image and a photoelectric image and an input substrate 4*a* for holding the input screen 5. In the X ray image tube 1*a*, the input substrate 4*a* comprises of a clad material 13 wherein an aluminum alloy material 11 on the X ray incidence side and a pure aluminum material 12 on the input screen side are provided integrally with each other in a form of cladding.

The input window 10 is made of the high strength aluminum alloy material as stated above to serve as part of the vacuum vessel on which atmospheric pressure directly acts. The outer periphery of the input window 10 is hermetically or vacuum-tightly joined to one end portion of a support frame 14 of high strength material. The other end portion of the support frame 14 is vacuum-tightly joined to the tip end portion of a sealing metal annular member 15 extending from the body of the vacuum vessel 2*a*.

As shown in the enlarged view of FIG. 2, the input substrate 4*a* comprises of the clad material 13 having the high strength aluminum alloy material 11 on the X ray incidence side and the pure aluminum material 12 on the input screen 5 side provided integrally with each other. The input screen 5 formed to be attached onto the inner surface of the pure aluminum material 12 of the input substrate 4*a* may be, but not limited to, a well-known screen including a phosphor layer comprising of columnar crystals made of activated cesium iodide (CsI), a photocathode layer formed on the surface of the phosphor layer and, if necessary, an intermediate layer and a conductive layer provided between the phosphor layer and the photocathode layer.

An outer peripheral flange 11*a* is formed on the outer peripheral portion of the input substrate 4*a*. The outer peripheral flange 11*a* is mechanically and electrically coupled to one end portion of the support frame 14*a*. The other end portion of the support frame 14*a* is put between and mechanically and electrically coupled and held by the support frame 14 and the tip end portion of the sealing metal annular member 15. A vacuum-tight joint is provided between the outermost periphery of the support frame 14 and that of the sealing metal annular member 15 by heli-arc welding to thus form an airtight welding part 16.

Air holes 17 are provided in the support frame 14*a* for fixedly supporting the input substrate 4*a*. The air holes 17 ensures that air is effectively exhausted in a space between the input window 10 and the input substrate 4*a*. A plurality of focusing electrodes 8*a* are coaxially arranged on the inner peripheral surface of the vacuum vessel 2*a* to form an electrostatic lens system.

Figure 3:
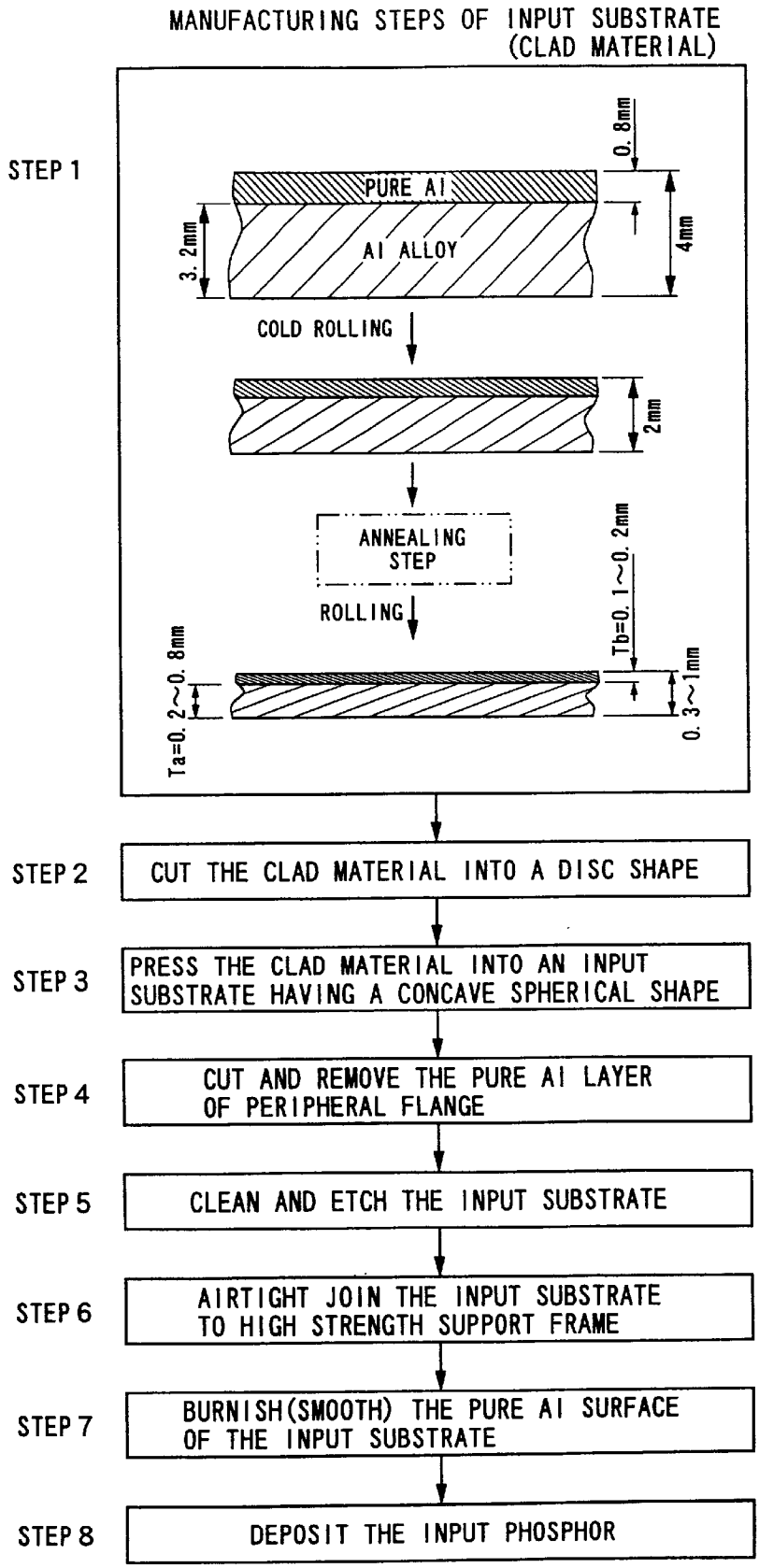
FIG. 3 is a block diagram showing manufacturing steps of the radioactive-ray image tube according to the present invention.

The X ray image tube 1*a* as stated above is manufactured through steps shown in FIG. 3. First, in a cladding process (Step 1), a clad material for constituting the input substrate is prepared. Thicknesses of materials for forming the clad material shown in FIG. 3 are only typical. A pure aluminum plate having a thickness of about 0.8 mm and an aluminum alloy plate having a thickness of about 3.2 mm are cold-welded (cold-rolled) into a layered member of about 2 mm in thickness.

Next, annealing processing is conducted under the atmosphere of forming gas comprising of nitrogen ($N_2$) and hydrogen ($H_2$), at a temperature of, for example, 250° C. for about 1.5 hours. The conditions for this annealing processing are a temperature between 100 and 600° C. preferably between 150 and 400° C., and a time period between 1 and 2 hours to form the clad material (clad member). By conducting this annealing processing, it becomes possible to greatly improve junction strength (bonding strength) of the clad material without using an intermediate material such as an adhesive agent.

Next, after a cold-rolling step, the layered member is prepared and controlled to be a clad material having a thickness suited for a purpose. By way of example, the thickness Ta of the aluminum alloy part of the clad material is about 0.8 mm and thickness Tb of the pure aluminum plate part is about 0.2 mm, thus the layered member (clad material) having an overall thickness of about 1.0 mm is prepared.

The overall thickness of the aluminum clad material constituting the input substrate in a state in which no atmospheric pressure is applied may be suitably, for example, 0.2 mm to 0.5 mm for the X ray image tube having the input screen with an effective diameter of not more than 9 inches, 0.5 mm to 0.8 mm for the X ray image tube having the input screen with an effective diameter of 12 inches and 1.0 mm to 2.0 mm for the X ray image tube having the input screen with an effective diameter of not less than 14 inches.

The overall thickness of the clad material used for the input substrate which also serves as the radioactive-ray input window of the vacuum vessel to be described later may be suitably, for example, 0.5 mm to 0.8 mm for the X ray image tube having the input screen with an effective diameter of 9 inches or less, 1.0 mm to 1.5 mm for the X ray image tube having the input screen with an effective diameter of 12 inches and 1.5 mm to 3.0 mm for an effective diameter of not less than 14 inches.

The above-prepared flat plane-like clad material is cut into a disc shape having a diameter slightly larger than that of the input window or the input screen formation region of the X ray image tube (Step 2). The diameter of the disc is, for example, about 260 mm for the 9-inch model X ray image tube and about 350 mm for the 12-inch model and about 440 mm for the 16-inch model.

Thereafter, the disc is pressed into a concave shape having a predetermined radius of curvature, with the aluminum alloy material placed on an outer surface (Step 3). If necessary, the pure aluminum material of an outer peripheral portion of the clad material is cut and removed to form a peripheral flange composed of only aluminum alloy (Step 4). The pressed member is then cleaned and etched (Step 5). The peripheral portion of the input substrate is airtightly joined to a high strength support ring (Step 6). The input screen forming face of the input substrate, i.e., the surface of the pure aluminum side is burnished (Step 7). An input screen such as a phosphor layer is deposited on the surface of this input substrate (Step 8). The input substrate is attached or mounted to the input window side and sealed as a vacuum vessel. The interior of the vacuum vessel is evacuated and a photocathode layer is deposited on the input screen, whereby the manufacture of an X ray image tube is completed.

Figure 4:
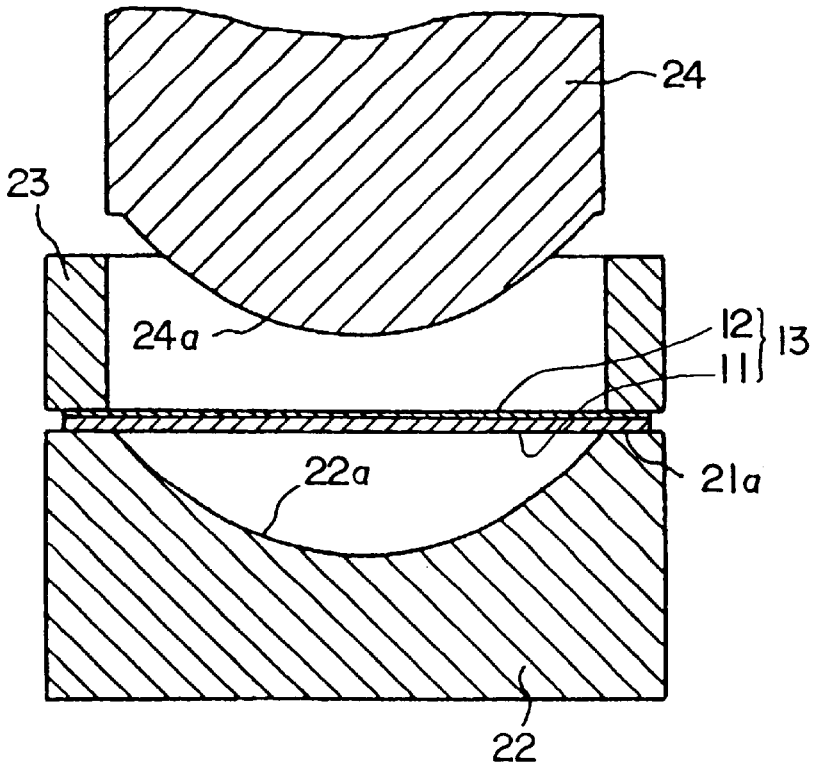
FIG. 4 is a cross-sectional view showing the structure of a pressing machine for pressing to bend a clad material and showing a state in which the clad material cut into a disc shape is installed to the machine.
Figure 5:
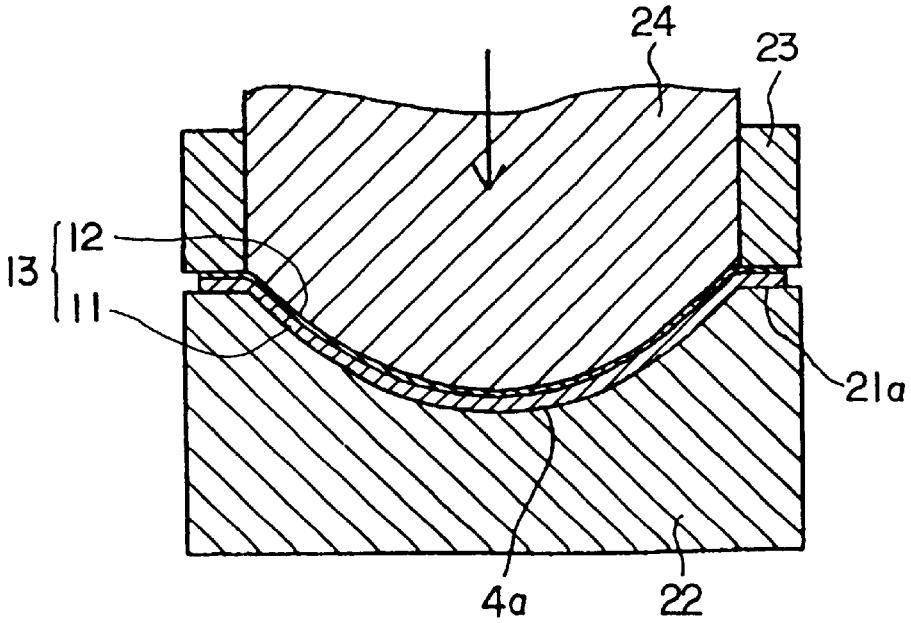
FIG. 5 is a cross-sectional view of the pressing machine showing a state in which the clad material is pressed from the state of FIG. 4 and formed into a bent shape.

Now, the respective manufacturing steps will be described. After cutting the clad material into a disc shape, the disc-shaped clad material 13 is placed on the lower die 22 of a pressing machine, as shown in FIG. 4. The peripheral portion 21*a* of the clad material 13 is held to be firmly constrained by a constraining die 23, and it is pressed by lowering an upper punch 24 with a predetermined pressure at normal temperature to produce the spherically-shaped input substrate 4*a* as shown in FIG. 5. The clad material 13 is positioned such that the aluminum alloy material 11 is on the lower die 22 side and the pure aluminum material 12 is on the upper punch 24 side. The press face 22*a* of the lower die 22 and the press face 24*a* of the upper die 24 have predetermined radii of curvature and are finished to mirror-like surfaces.

Figure 6:
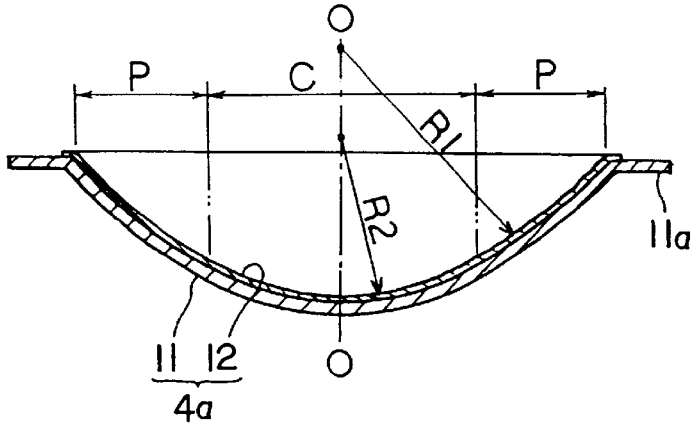
FIG. 6 is a cross-sectional view showing the shape of the input substrate pressed to be bent.

It is preferable that the radius of curvature of each region of the input substrate 4*a* thus formed into spherical shape is normally set as shown in FIG. 6, which serves as a condition necessary for the electron emitting cathode surface of an electron lens. That is, the radius of curvature $R_1$ in the central region C of the input substrate 4*a* is set to be smaller than the radius of curvature $R_2$ in the peripheral region P.

In FIG. 6, the outer peripheral flange 11*a* formed on the outer peripheral portion of the input substrate 4*a* is made of only aluminum alloy material 11. The outer peripheral flange 11*a* is formed by cutting and removing the pure aluminum material 12 of the outer peripheral portion of the input substrate 4*a*.

Figure 7:
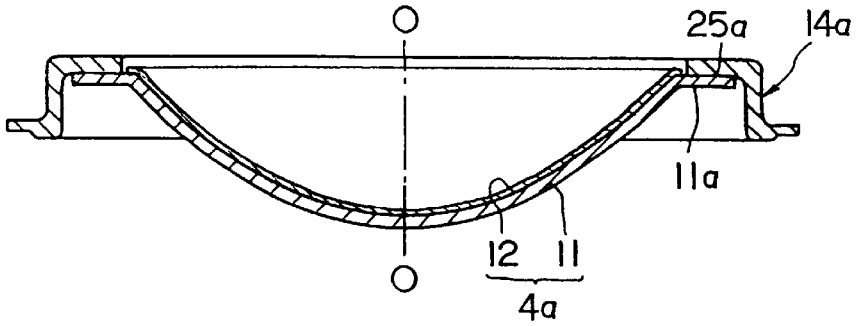
FIG. 7 is a cross-sectional view showing a state in which a support frame is installed on the outer periphery of the input substrate from the state of FIG. 6.

The pressed input substrate 4*a* is then degreased and cleaned. That is, to remove, for example, an oxide film, etching processing is conducted , i.e., the entire surface of the input substrate 4*a* is dipped into, for example, nitric acid or the like for a short period of time. Thereafter, as shown in FIG. 7, the joined face on the outer peripheral flange 11*a* of the input substrate 4*a* is airtight joined to the joined face 25*a* of a thick stainless steel support frame 14*a* by, for example, local thermo-compression bonding method or the like.

Figure 8:
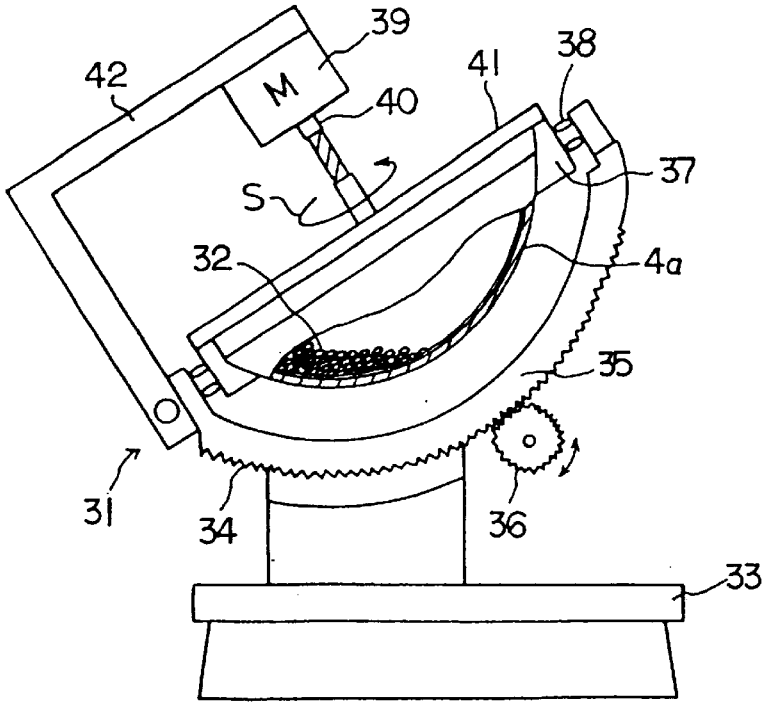
FIG. 8 is a front view showing the structure of a burnishing device for smoothing the pure aluminum material surface of the input substrate.

At least the inner surface of the pure aluminum material of the input substrate 4*a* thus prepared has many minute irregularities due to rolling lines, etching or the like. As shown in FIG. 8, the input substrate 4*a* is fixed to a burnishing machine 31 and a large number of micro-balls 32 are put in the concave inner face of the substrate 4*a,* i.e., the surface of the pure aluminum material. The input substrate 4*a* is continuously rotated for a predetermined period of time to thereby perform burnishing treatment.

The burnishing is a fabricating method (working method) that, for example, micro-balls are rolled or another tool is pressed and slid on the subject face of the substrate to crush small projections on the surface and also fill minute recesses, thereby smoothing the surface. Therefore, this method does not shave to remove the projections on the subject surface of the input substrate, so that substantially no micro cut scraps or shavings of the substrate material are produced by this method.

The burnishing machine 31 comprises a base 33 which also serves as vibrator, an inclination angle adjusting arm 35 having a teeth 34 continuously arranged in a circular-arc shape, a drive gear 36 for driving the arm 35, a substrate holder 37 for cramping the substrate, a bearing 38 for rotatably supporting the holder 37, a rotation drive motor 39 for rotating the substrate holder, a rotating shaft 40 for the motor 39, a rotating cover 41 which is connected to the shaft 40 to transmit a turning force and also serve as a lid for the substrate, and a motor support arm 42. A similar device is disclosed in German Patent Application Laid-Open No. 2435629 and can also be used in this invention.

In the burnishing step, the input substrate 4*a* is fixed to the substrate holder 37 of the machine, and a predetermined number of micro-balls 32 are placed inside the input substrate 4*a*. The rotating cover 41 integral with the motor 39 is placed to cover the input substrate 4*a* and fixed to the substrate holder 37. The motor 39 is driven to rotate the input substrate 4*a* as indicated by an arrow S at a speed of, for example, about one turn per second.

The micro-balls 32 are made of, for example, a metal material such as stainless steel or alumina ceramic, having Vickers hardness of two times or higher than the material of the input substrate 4*a*. The micro-balls 32 have an average diameter in a range of 0.3 mm to 3.0 mm and are preferably generally round balls having a diameter of, for example, 1.0 mm. For example, in processing the input substrate for 12-inch model, a large number of micro-balls 32 in a weight of about 500 g in all were placed, and the input substrate was rotated for about 60 minutes. Thus, minute projections on the inner surface of the input substrate are gradually crushed by the rolling micro-balls, many etch pits are gradually filled accordingly, and gentle irregularities not having directivity produced by the pressing operation described above are smoothed as described afterward, with the shape and dimensions remaining substantially as they are.

In the burnishing step, a method of turning the substrate using a predetermined number of micro-balls is preferable because the shape of the subject substrate and the radius of curvature are not changed substantially. It is not, however, limited to this method, and it is also possible to use means for moving at least one of the substrate and a contact medium to crush the minute projections on the substrate surface, while pressing the contact medium to the substrate surface under an appropriate pressure so as not to deform the substrate.

The inclination angle adjusting arm 35 is properly adjusted by the burnishing device 31 as required to continuously or stepwise change the inclination of the rotation center shaft of the input substrate 4*a,* or vibrations are properly applied by the vibrator to change a level of the burnishing processing of the center region, middle region or peripheral region of the input substrate.

Otherwise, the speed of inclining the inclination angle adjusting arm 35 is determined not constant but, for example, slowed as the inclination is increased, or the turning speed of the substrate by the motor 39 is decreased when the inclination angle is increased to gather the micro-balls mainly at the peripheral region, thus a contact duration of the substrate surface and the balls per unit area for each subject region of the substrate surface can be changed as desired. Besides, the structure can be formed to give a desired motion so that the micro-balls are rolled, moved or scrubbed on the substrate surface.

As described above, in the burnishing processing, minute projections are hardly shaved and undesired fine powder is not produced. Therefore, cleaning for removing the minute powder is not necessary. However, if minute powder or the like in a small amount is produced as described in the later embodiment, dry cleaning or wet cleaning is to be conducted.

After the burnishing step as described above, an aluminum deposited layer as the layer of optically reflective layer is formed to a thickness of, for example, about 3000 angstroms (A) on the input screen forming surface of the input substrate 4*a*. This optically reflective layer may be omitted; however, it is useful if it is necessary to set optical reflectance of the input screen forming surface at a predetermined value or to remove defects such as stains over the entire input substrate surface.

Then, an input screen 5 is formed to be attached onto the input substrate surface. Specifically, a phosphor layer made of cesium iodide (CsI) activated by, for example, sodium (Na) is deposited on the surface of the pure aluminum material of the input substrate surface by a known deposition method to provide a fine columnar crystal structure having a thickness of, for example, 400 to 500 $\mu$m. An average of diameters of the respective columnar crystals of the phosphor layer is in a range of about 6 to 10 $\mu$m, for example, about 8 $\mu$m. If necessary, an optically transparent intermediate layer and an optically transparent conductive layer may be formed on the phosphor layer made of an aggregate of columnar crystals so as to connect the tip end portions of the respective crystals.

The input substrate is equipped to the radioactive-rays input window side of the vacuum vessel. Then, required portions are airtightly welded and sealed as a vacuum vessel, its interior is evacuated by an exhaust apparatus and a photocathode layer is deposited, thereby completing the input screen 5.

According to the X ray image intensifier tube 1*a* having a structure as shown in FIGS. 1 through 2 in this embodiment, the input substrate 4*a* is formed of the clad material 13 comprising of the high strength aluminum alloy material 11 and the pure aluminum material 12 of good plane quality. Owing to this, compared to the conventional input substrate 4 consisting only of pure aluminum material, the input substrate in this embodiment has less deformations such as a twist and can lessen the thickness to a minimum requirement of about 0.2 to 2.0 mm. For that reason, the spherical aberration of an output image is small, the absorption of radioactive rays at the input substrate 4*a* is effectively suppressed and the resolution and brightness uniformity of the image tube 1*a* can be improved.

On the surface of the pure aluminum material for forming the input screen of the input substrate 4*a*, irregularities due to preparation and pressing of the clad material are smoothed by the burnishing processing. Owing to this, among light emitting at the phosphor layer, that reflecting within the respective columnar crystals in the direction of the input substrate surface or the light reflecting film on the surface returns to the inside of the same columnar crystals and reaches the photocathode layer. As a result, brightness uniformity and resolution characteristics can be improved.

When comparing the state of the input substrate surface which improved characteristics had been recognized in this embodiment with a conventional one, the following facts were confirmed. Specifically, irregularity profiles of various input substrate surfaces are shown in FIGS. 9 through 12. They were measured by the tracer type surface roughness measurement specified by JIS (Japanese Industrial Standard).

Figure 9:
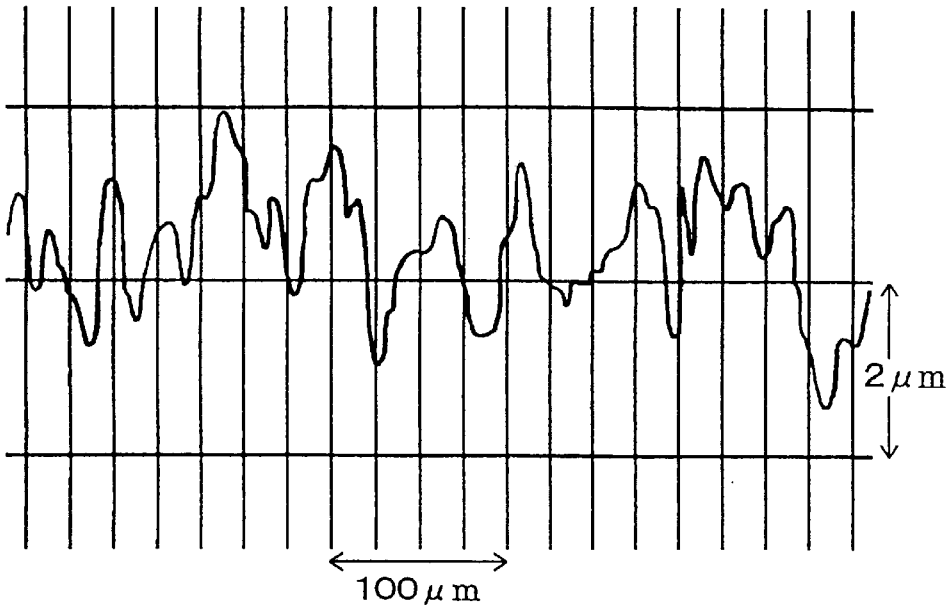
FIG. 9 is a graph showing the irregularity profile on the pure aluminum material surface of the input substrate before being pressed to bend.

FIG. 9 shows the irregularity profile of the surface on the pure aluminum material side of a flat plane-like clad material before being pressed into the curved surface, which clad material has a thickness of 0.5 mm and comprises of an aluminum alloy material of 0.4 mm in thickness and a pure aluminum material of 0.1 mm in thickness. The horizontal axis indicates a position in the plane direction of the clad material (or input substrate) and the vertical axis indicates a position in the thickness direction. This is applied to other irregularity profiles.

As is obvious from the irregularity profile of FIG. 9, numerous minute irregularities including rolling lines generated during rolling are observed on the pure aluminum material surface of the clad material.

Figure 10:
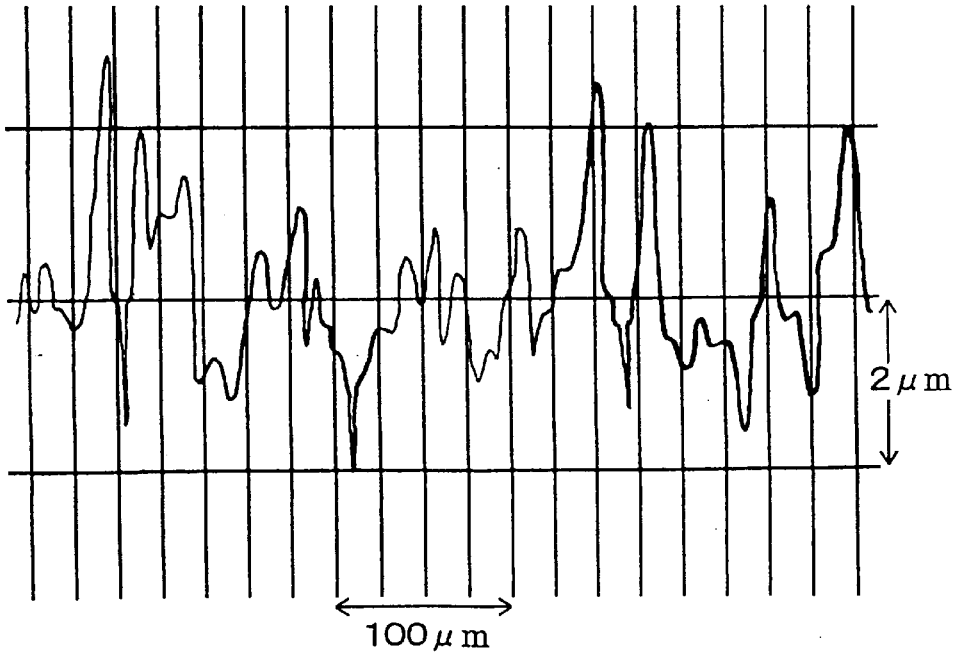
FIG. 10 is a graph showing the irregularity profile on the pure aluminum material surface of the input substrate after being etched.

FIG. 10 shows the irregularity profile of the pure aluminum material surface of the above clad material which had been pressed into an input substrate having a predetermined concave curved surface and then subjected to etching processing for about 15 minutes to clean the surface of the pure aluminum alloy material. It is observed from FIG. 10 that numerous minute irregularities with greater differences in heights as well as many etch pits are formed on the input substrate surface which were subjected to pressing and etching processing.

Figure 11:
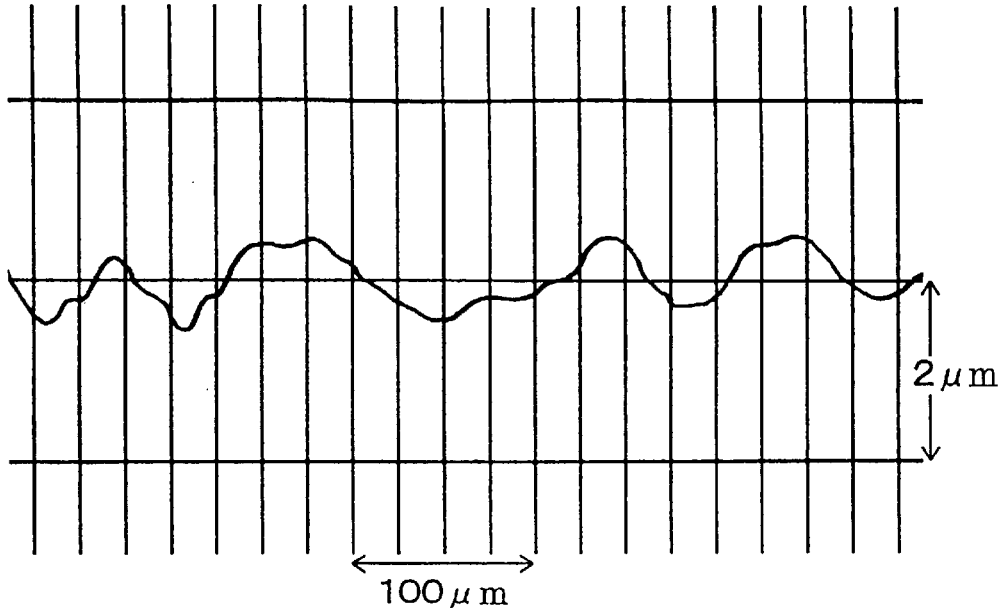
FIG. 11 is a graph showing the irregularity profile on the pure aluminum material surface of the input substrate after being burnished.

FIG. 11 shows the irregularity profile of the surface of the pure aluminum material in case the input substrate which had been etched as mentioned above were subjected to burnishing processing for about 50 minutes.

It is obviously seen from FIG. 11 that after burnishing processing, sharp irregularities generated during pressing are changed to gentle irregularities and substantially all of the numerous minute irregularities existing prior to burnishing have been removed.

Figure 12:
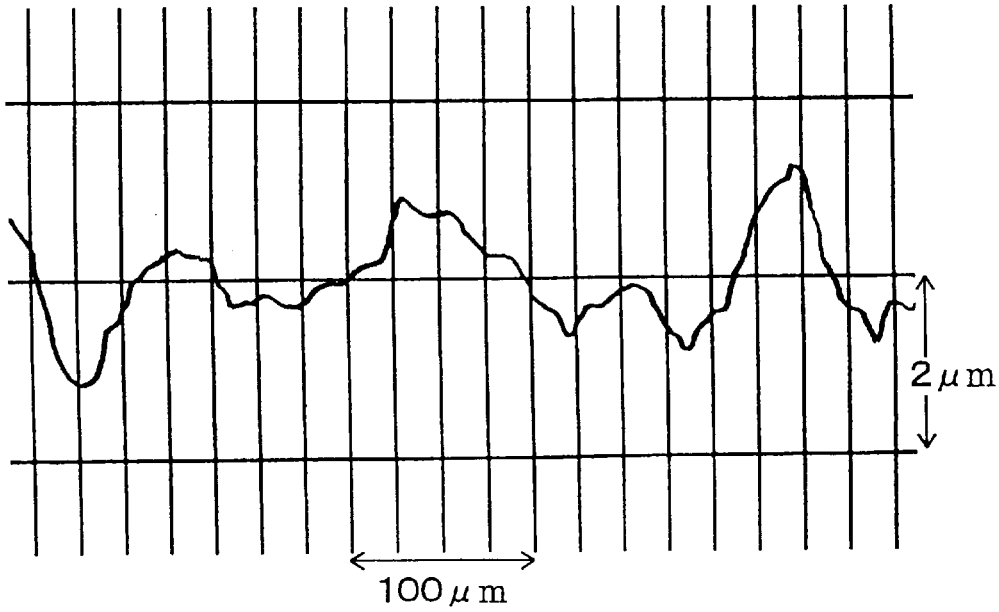
FIG. 12 is a graph showing the irregularity profile of the input substrate consisting only of aluminum alloy after burnishing processing.

FIG. 12 is a graph showing the irregularity profile of the surface of the input substrate consisting only of an aluminum alloy material of 0.5 mm in thickness which were subjected to pressing, etching and burnishing processes under the same conditions as described above, as a comparison. It is obviously seen from FIG. 12 that irregularities on the surface are not sufficiently removed even after burnishing processing was conducted to the input substrate consisting only of the aluminum alloy material. Comparing the input substrate of FIG. 12 with those in this embodiment, it was confirmed that irregularities become coarse and minute irregularities are left.

From these facts, it is obvious that if the surface of the pure aluminum material of the input substrate comprising of the clad material are subjected to burnishing processing, minute irregularities have been greatly reduced. According to the manufacturing method in this embodiment, therefore, minute irregularities caused by rolling, pressing or etching the clad material comprising of pure aluminum and aluminum alloy can be greatly removed by burnishing processing.

In this embodiment, it is possible to realize an X rays image tube capable of preventing the lowering of brightness uniformity and resolution, reducing the aberration of the electron lens system resulting from the twist of the input substrate or the state of the surface, that is, the spherical aberration and/or astigmatism as well as image noise while maintaining sufficient adhesive strength of the input screen to the input substrate.

Figure 13:
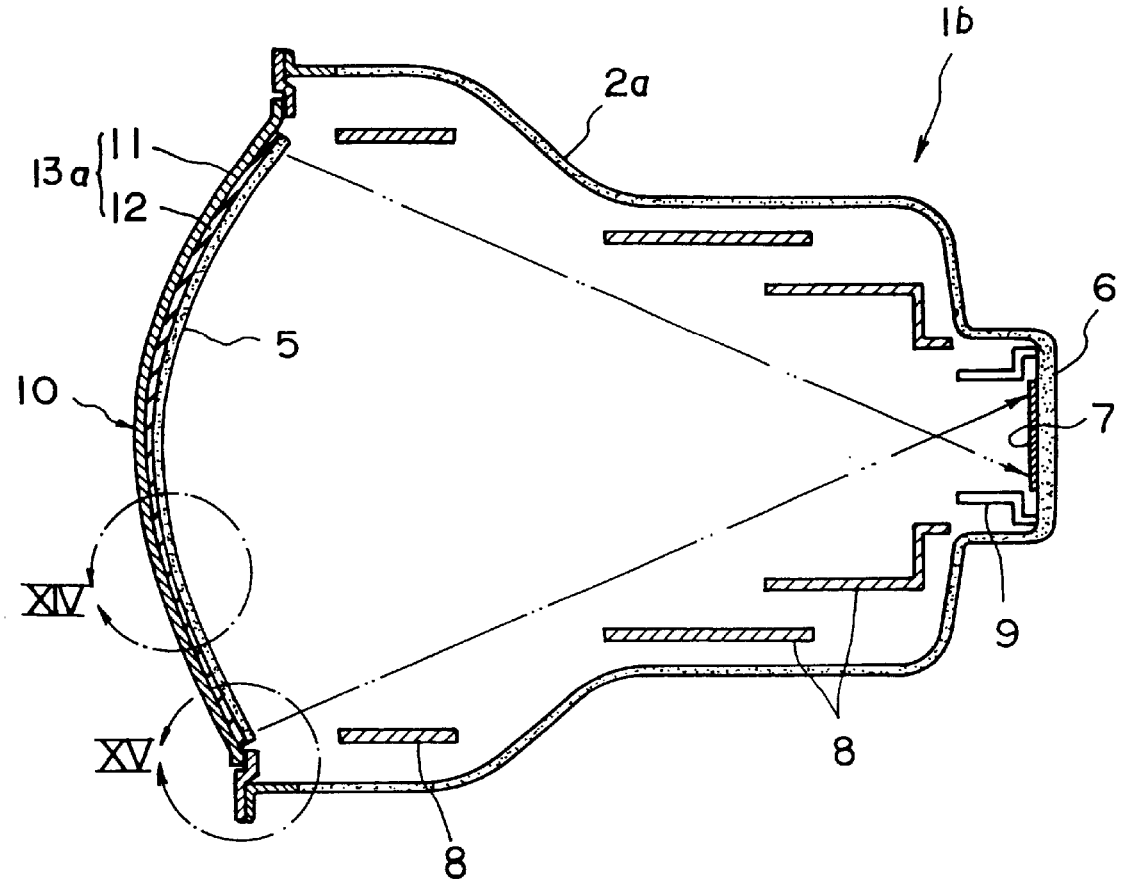
FIG. 13 is a cross-sectional view showing another embodiment of the radioactive-ray image tube according to the present invention.
Figure 14:
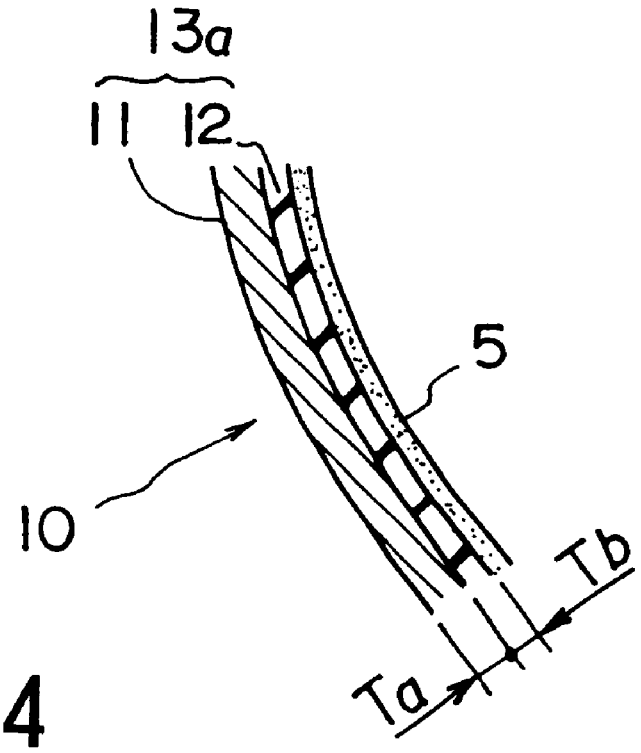
FIG. 14 is a cross-sectional view of partially enlarged part XVI of FIG. 13.
Figure 15:
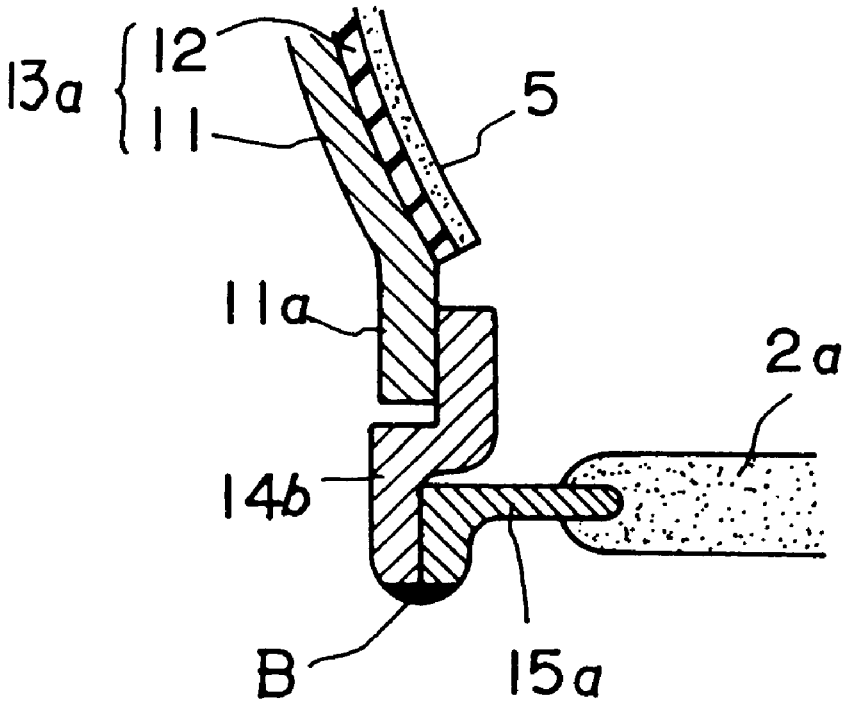
FIG. 15 is a cross-sectional view of partially enlarged part XV of FIG. 13.

Next, description will be given to another embodiment of a radioactive-ray image intensifier tube wherein an aluminum clad input substrate also serves as an X ray input window i.e., a part of a vacuum vessel, with reference to the accompanying drawings. FIGS. 13 through 15 are cross-sectional views showing the embodiment applied to the 9-inch model X ray image tube 1*b* (with an effective diameter of 230 mm) of the present invention. Same reference numerals denote same elements, to which no description will be given.

Namely, the X ray image tube 1*b* of another embodiment according to the present invention has a structure in which an input substrate 13*a* which also serves as an X ray input window 10 as a part of a vacuum vessel is airtightly joined to the vacuum vessel 2 a having a body and an output window 6 made of glass and in which an input screen 5 is directly formed on the inner surface of this input substrate 13*a*.

The input substrate 10 also serving as the X ray input window of the vacuum vessel comprises of a clad material 13*a* having a high strength aluminum alloy material 11 on the X ray incidence side and a pure aluminum material 12 on the input screen 5 side integrally provided with each other, as shown in the expanded view of FIG. 14.

The input substrate 10 which also serves as the X ray input window of the vacuum vessel was manufactured by the following procedures. First, A6061 material (proof stress: 73.6 $N/mm^2$) as the high strength aluminum alloy material and A1050 material as the pure aluminum material are rolled with one material put upon another. By so doing, a clad material having an overall thickness of 1.0 mm, the thickness ratio (Ta:Tb) of the high strength aluminum alloy to the pure aluminum material of 4:1 and a width of 250 mm was prepared.

Then, the clad material thus obtained is cut into a circular shape and pressed into an input window 10 having a radius of curvature of about 200 mm and a predetermined hyperboloid surface with a central portion protruding toward the atmospheric air side. As shown in FIG. 15, a flat outer peripheral flange 11*a* consisting only of the high strength aluminum alloy material 11 was formed on the outer periphery of the input window 10 by partially removing the pure aluminum material.

Next, as shown in FIG. 15, the flat outer peripheral flange 11*a* formed on the outer periphery of the X ray input window 10 was put on a high strength support frame 14*b* made of thick iron which had been plated with nickel in advance or iron alloy such as stainless steel and, at the same time, arranged between a joint apparatus consisting or upper and lower joints. The flange 11*a* was then heated and pressed to be thereby airtight joined to the support frame 11*b*, thus forming a joint part B. The airtight joint may be conducted by a brazing and soldering method while pressure is slightly applied in a state in which a thin brazing ring is put between the outer peripheral flange 11*a* and the support frame 14*b*.

The outer peripheral flange airtightly joined to the high strength support frame 14*b* as stated above is desirably made only of high strength aluminum alloy by partially cutting and removing the pure aluminum material 12 so as to increase joint strength and to ensure structural strength against vacuum pressure.

As the same in the case of the preceding embodiment, the surface of the pure aluminum material was subjected to burnishing processing. An input screen 5 was then formed on the pure aluminum material side of the input window substrate integral with the support frame 14*b*. The phosphor layer of this input screen comprises of cesium iodide (CsI) activated by sodium (Na). The phosphor layer was formed by the vacuum evaporation method. Specifically, CsI layer having a thickness of about 400 $\mu$m was first deposited under pressure of $4.5\times10^{-1}$ Pa and CsI layer having a thickness of about 20 $\mu$m was further deposited thereon under pressure of $4.5\times10^{-3}$ Pa. Thereafter, a transparent conductive film was attached onto the phosphor layer.

As shown in FIGS. 13 and 15, the high strength support frame 14*b* integral with the input window 10 at which the phosphor layer 5 was provided was joined to the tip end portion of the glass body which was part of the vacuum vessel 2*a* in advance. The high strength support frame 14*b* was then contacted with a sealing metal annular member 15*a* comprising of, for example, Fe—Ni—Co alloy and the outer periphery of the contact portion was airtightly welded at a welding portion B by an arc welding device. The interior of the vacuum vessel 2*a* was thereafter evacuated. As a result, the X ray image tube shown in FIG. 13 was thus manufactured.

According to the X ray image tube 1*b* of this embodiment, the input substrate which also serves as the input window 10 of the vacuum vessel, comprises of the clad material 13*a* having the high strength aluminum alloy material 11 and the soft pure aluminum material 12 provided integrally with each other. Due to this structure, the following advantages can be obtained. Namely, the scattering and transmittance loss of X rays are small at the input part. Besides, deformations such as the twist of the input substrate hardly occur; efficiency in use of radioactive rays can be improved; and an output image having less spherical aberration and astigmatism, brightness uniformity, high contrast properties and high resolution can be obtained.

Since the phosphor layer 5 is deposited on the inner surface of the pure aluminum material 12 having soft and good plane quality, it becomes possible to form a uniform, smooth phosphor layer 5 and to reduce noise, thereby to greatly improve resolution.

Moreover, a single sheet of clad material 13*a* can function as both the input window and the input substrate, which have been separately fabricated and assembled in the conventional case. This results in a decrease in the number of parts and in a simpler manufacturing and assembly steps, so that the manufacturing costs of radioactive-ray image tubes can be thereby greatly reduced.

The following comparison test was conducted to confirm the advantage of the X ray image tube 1*b* of this embodiment. A high strength aluminum alloy of 0.8 mm in thickness (A6061 material) was pressed to form an input window 3 having the same radius of curvature and dimensions as those of the input window 10 in the embodiment. A pure aluminum material of 0.5 mm in thickness (A1050 material) was pressed to prepare an input substrate having the same radius of curvature and dimensions as those of the input window 10 in the embodiment. The same phosphor layer 5 as in the embodiment was deposited inside the input substrate 4. Next, while the input window 3 was firmly fixed to one side surface of the vacuum vessel 2, the input substrate 4 was arranged within the vacuum vessel 2 to have a distance of 12 mm from the input window 3. Thus, as shown in FIG. 18, an X ray image tube 1 according to the conventional case was prepared.

Changes of efficiency in use of X rays were measured for the X ray image tubes 1*b* and 1 in the embodiment of the present invention and the conventional case, respectively. Contrast characteristics of the transmitted image resulting from the scattering of X rays at the input part were also measured for the X ray image tubes 1*b* and 1, respectively. The efficiency in use of X rays was evaluated base on efficiency in detecting the quantum of X rays having energy of 60 keV. The contrast characteristics of the transmitted image was evaluated based on a small area contrast ratio (10 mm ϕ contrast ratio) which is important for diagnoses. The measurement and evaluation result are shown in Table 1 below.

TABLE 1

| | Efficiency in Use of X rays (%) | Contrast Characteristic |
|---|---|---|
| Embodiment | 74 | 24:1 |
| Conventional Example | 60 | 17:1 |

As is obvious from the result shown in Table 1, the X ray image tube provided with the input window comprising of the clad material of this embodiment according to the present invention has a smaller scattering quantity of X rays at the input part than the conventional X ray image tube with a double structure comprising of the input window and the input substrate, and can improve the efficiency in use of X rays by 20% or more.

It was also confirmed that the small area contrast ratio important for diagnoses increases from 17:1 to 24:1 and an X ray image tube having high resolution and less noise can be obtained. As a result, it is possible to improve the quality of the photofluorographic output image in the X ray diagnostic system and thereby to greatly improve diagnostic accuracy.

In addition to the above embodiments, the X ray image tubes were fabricated by preparing various types of clad materials. Specifically, the thickness of the high strength aluminum alloy material (A6061P-0 material) ranges from 0.7 to 0.9 mm and that of the pure aluminum material (A1050P material) ranges 0.2 to 0.5 mm. Using the X ray image tubes, the influence of the different thicknesses on the efficiency in use of X rays and contrast characteristics was compared and measured. The following result was obtained. Specifically, even if the thicknesses of the respective materials increased by 0.2 mm, the characteristics values of the X ray image tubes changed from those of the X ray image tube in the above embodiment only by about 1%.

Figure 16:
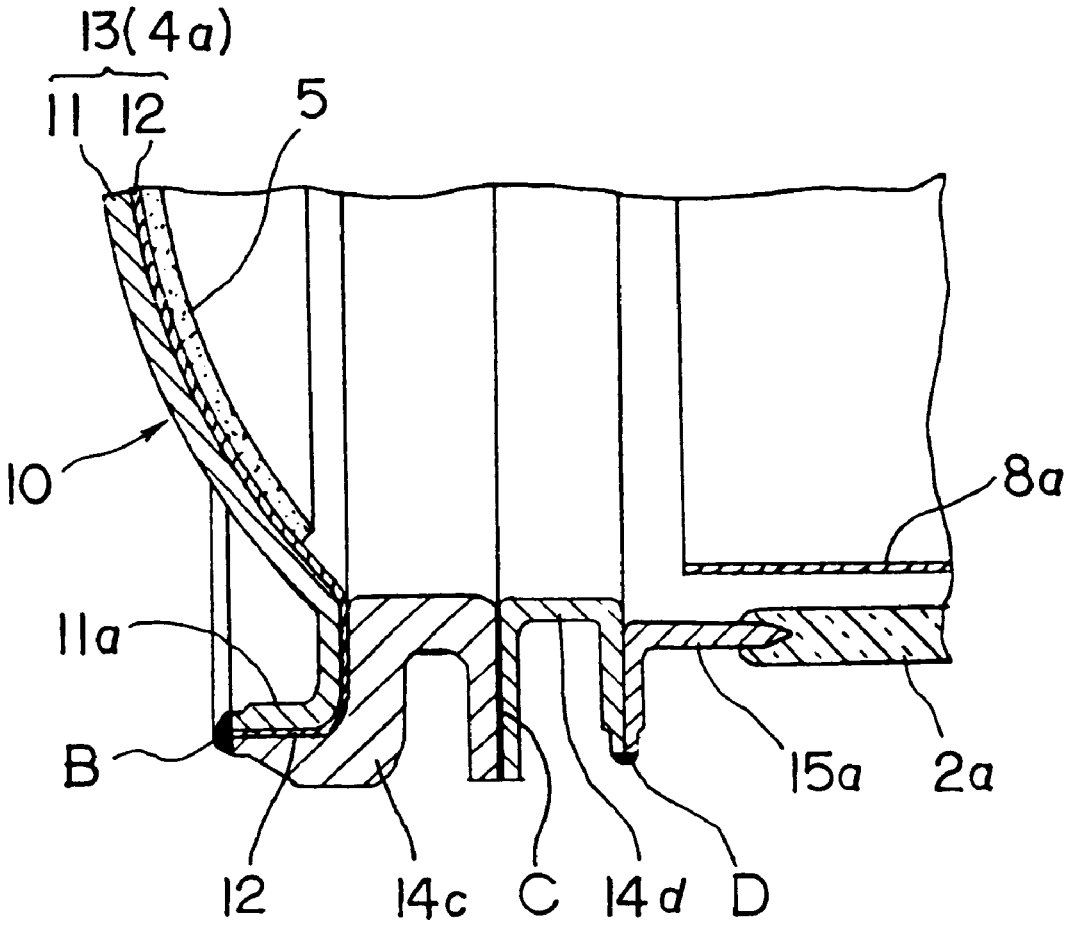
FIG. 16 is a longitudinally sectional view of important parts and showing yet another embodiment of the radioactive-rays image tube according to the present invention.

In the embodiment shown in FIG. 16, the outer peripheral flange 11*a* of an input substrate 4*a* which also serves as an input window 10 comprising of an aluminum clad material 13 is vacuum-airtightly joined (bonded) to a support frame 14*c* made of thick aluminum material at a welding part B on the tip end. In this case, the pure aluminum material 12 is not removed from but remains at the outer peripheral flange 11*a*, and joined, together with the aluminum alloy material 11, to the support frame 14*c*. The support frame 14*c* made of thick aluminum alloy material is integrally joined to an auxiliary support frame 14*d* of iron alloy in advance at an airtight brazing part C. The support frames 14*d* and 14*c* which have been integrally joined together in advance are joined to the input substrate 4*a* at the welding part B, to which the input screen 5 is deposited and attached. Thereafter, the outer periphery of the auxiliary support frame 14*d* is airtightly joined to the outer periphery of the iron alloy annular body 15*a* of the vacuum vessel at a heli-arc welding part D and sealed as a vacuum vessel. This makes it possible to prevent brazing heat or welding heat at the respective brazing parts from directly entering and adversely affecting the input screen.

Figure 17:
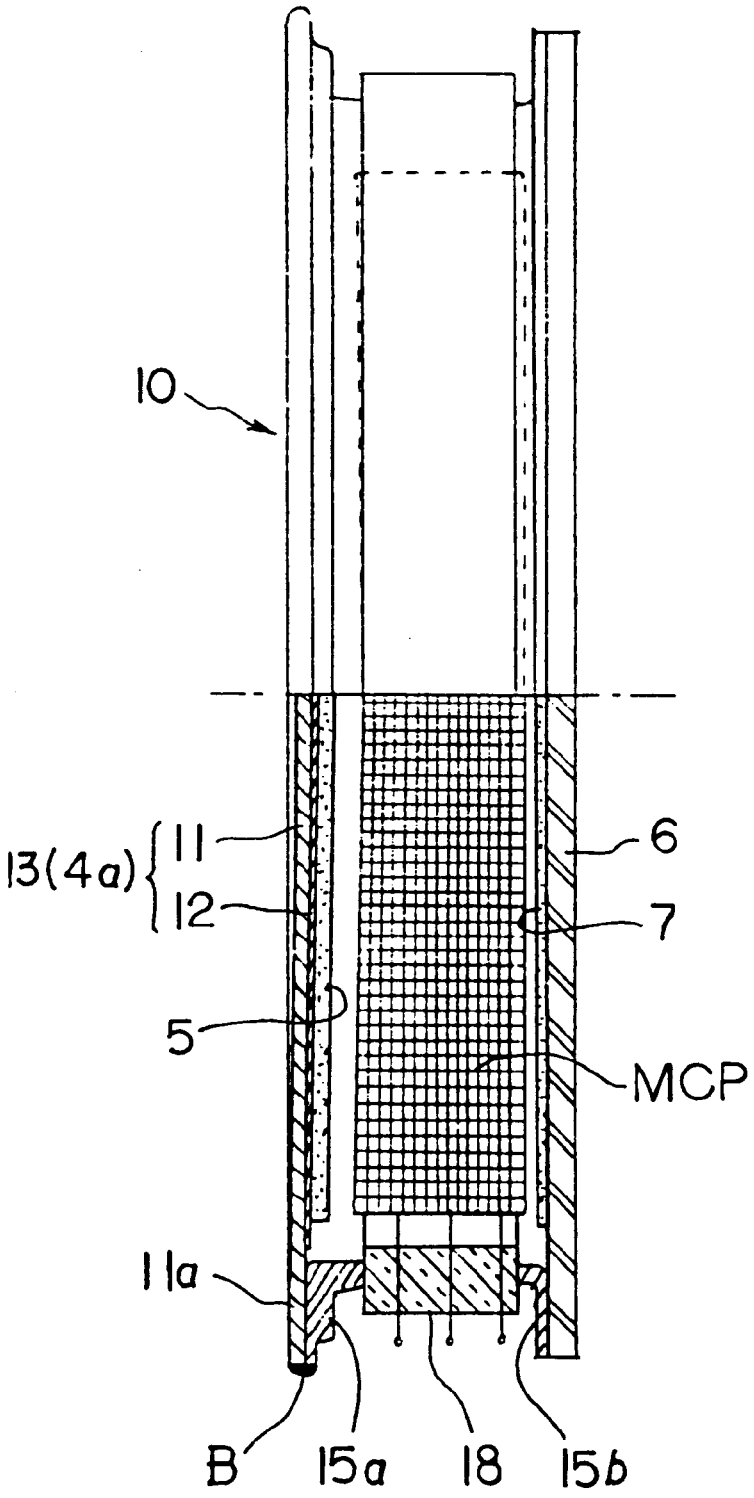
FIG. 17 is a half longitudinally sectional view showing yet another embodiment of the radioactive-ray image tube according to the present invention.

The embodiment shown in FIG. 17 is an X ray image intensifier tube wherein an input substrate 4*a* which also serves as an input window 10 and comprises of an aluminum clad material 13 is used in a flat plate shape or substantially flat plate shape which is slightly depressed by the atmospheric pressure. The vacuum vessel of this X ray image tube comprises a flat disc-like input substrate 4*a* comprising of an aluminum clad material and also serving as an X ray input window 10, a sealing metal annular body 15*a*, an insulating ceramic ring 18, and a flat disc-like output glass 6 which is vacuum-tightly deposited to another sealing metal annular member 15*b*. The outer peripheral flange 11*a* of the input substrate 4*a* comprising of the clad material 13 is airtightly welded to the sealing metal annular member 15*a* which also serves as a high strength support frame at a welding part B.

An input screen 5 is deposited onto the inner surface of the input substrate 4*a*. A micro-channel plate (MCP) is arranged proximate to the input screen 5. An output screen 7 is deposited onto the inner surface of the disc-like output glass 6 arranged proximate to the output side of MCP. As a result, the relatively thin flat plate-like X ray image tube is thus formed.

The input substrate 4*a* comprising of the aluminum clad material 13 and having the input screen attached thereto may be separate from the X ray input window of the vacuum vessel and arranged away from or proximate to the vacuum region side of the X ray input window. With such an arrangement, the input substrate can be made of a considerably thin aluminum clad material without the need to take account of the atmospheric pressure.

As described above, in the radioactive-ray image tube according to the present invention, both the input window and the input substrate comprise of the clad material wherein the high strength aluminum alloy material and the soft pure aluminum material are integral with each other. Due to this structure, the input substrate has less deformations such as twist and can be formed into relatively thin plate, whereby the scattering and transmittance loss of the radioactive rays at the input part are smaller. As a result, it is possible that the electron lens system has less spherical aberration and astigmatism, that an output image is excellent in brightness and resolution uniformity and that high contrast characteristics are obtained.

Further, since the phosphor layer is deposited on the inner surface of the pure aluminum material having the soft and good plane quality, the phosphor layer can be formed into uniform and smooth layer, as well and noise can be reduced to thereby greatly improve resolution. That is, since the inner surface of the input window to which the input phosphor surface is directly attached is made of pure aluminum, minute irregularities on the inner surface can be easily crushed and smoothed by burnishing treatment in which a large number of metal or ceramic micro-balls of about 1 mm in diameter are put and rotated.

Moreover, if the input substrate is formed to also serve as an input window, a single sheet of clad material can function as both the input window and input substrate which have been conventionally fabricated separately and assembled. Due to this structure, the number of parts for the image tube is decreased and manufacturing and assembly steps can be simplified, thereby allowing manufacturing costs of radioactive-ray image tubes to be reduced considerably.

According to the present invention, therefore, there can be obtained a radioactive-ray image tube having less deformations, such as a twist, to the input substrate, having smaller aberration over the entire regions of an output image and excellent resolution as well as good brightness uniformity and contrast characteristics.

What is claimed is:

1. A radioactive-ray image tube comprising:

a vacuum vessel having one side serving as a radioactive-ray input window on which radioactive-rays are incident;

an input screen for converting a radioactive-ray image formed by said incident radioactive-rays into a fluorescent image and a photo-electron image;

an input substrate having the input screen deposited onto one surface thereof; and an output screen provided on the other side of the vacuum vessel, and wherein the input substrate is formed of a clad material provided by rolling and cladding an aluminum alloy material on the radioactive-ray incidence side with a pure aluminum plate on the side onto which the input screen is deposited; and wherein the clad material for constituting the input substrate has a thickness ratio (Ta:Tb) of a thickness (Ta) of the aluminum alloy material to a thickness (Tb) of the pure aluminum plate falling within a range of (1:2) to (80:1).

2. A radioactive-ray image tube comprising:

a vacuum vessel having one side serving as a radioactive-ray input window on which a radioactive-ray is incident:

an input screen for converting a radioactive-ray image formed by said incident radioactive-rays into a fluorescent image-and a photo-electron image;

an output screen provided on the other side of the vacuum vessel, and wherein the input window is formed of a clad material provided by cladding an aluminum alloy material on the radioactive-ray incidence side with a pure aluminum material on the side onto which the input screen is directly deposited; and wherein the clad material for constituting the input window has a thickness ratio (Ta:Tb) of a thickness (Ta) of the aluminum alloy material to thickness (Tb) of the pure aluminum material falling within a range of (1:2) to (80:1).

3. The radioactive-ray image tube according to claim 1 or 2, wherein the radioactive-ray input window or the input substrate is formed into substantially a spherical shape protruding in a direction in which the radioactive-ray is incident.

4. The radioactive-ray image tube according to claim 1 or 2, wherein the radioactive-ray input window or the input substrate is formed into a shape of substantially flat plate.

5. The radioactive-ray image tube according to claim 1, wherein an entire thickness of the clad material constituting the input substrate falls within a range of 0.2 to 2.0 mm.

6. The radioactive-ray image tube according to claim 2, wherein an entire thickness of the clad material constituting the input window falls within a range of 0.5 to 3.0 mm.

7. The radioactive-ray image tube according to claim 1 or 2, wherein the aluminum alloy material of the clad material constituting the input substrate or input window has an aluminum content of less than 99% by weight and a proof stress of not less than 4 kg/mm$^2$ and the pure aluminum material thereof has an aluminum content of not less than 99% by weight and a proof stress of not more than 3 kg/mm$^2$.

8. The radioactive-ray image tube according to claim 1 or 2, wherein the aluminum alloy material of the clad material constituting the input substrate or input window is an alloy including Si of not more than 0.6% by weight, Fe of not more than 0.8% by weight, Cu of not more than 0.30% by weight, Mn of not more than 1.5% by weight, Mg of not more than 1.3% by weight, Cr of not more than 0.20% by weight, Zn of not more than 0.40% by weight, an inevitable impurity element of not more than 0.15% by weight and Al of a remaining % of weight.

9. The radioactive-ray image tube according to claim 1 or 2, wherein the aluminum alloy material of the clad material constituting the input substrate or input window is an alloy including Si of not more than 0.4% by weight, Fe of not more than 0.7% by weight, Cu of not more than 0.2% by weight, Mn of not more than 1.0% by weight, Mg of not more than 5.0% by weight, Cr of not more than 0.35% by weight, Zn of not more than 0.25% by weight, an inevitable impurity element of not more than 0.15% by weight and Al of a remaining % of weight.

10. The radioactive-ray image tube according to claim 1 or 2, wherein the aluminum alloy material of the clad material constituting the input substrate or input window is an alloy including Si of 0.4 to 0.8% by weight, Fe of not more than 0.7% by weight, Cu of 0.15 to 0.4% by weight, Mn of not more than 0.15% by weight, Mg of 0.8 to 1.2% by weight, Cr of 0.04 to 0.35% by weight, Zn of not more than 0.25% by weight, an inevitable impurity element of not more than 0.15% by weight and Al of a remaining % of weight.

11. The radioactive-ray image tube according to claim 2, wherein an outer peripheral flange mainly comprising of the aluminum alloy material is formed on an outer peripheral portion of the radioactive-ray input window of the vacuum vessel, the outer peripheral flange being formed by partially removing the pure aluminum material from the clad material, and the outer peripheral flange being vacuum-tightly joined to a peripheral portion of the vacuum vessel directly or through a metal support frame.

12. The radioactive-ray image tube according to claim 2, wherein one end portion of a support frame made of pure aluminum or aluminum alloy is vacuum-tightly joined to an outer peripheral portion of the radioactive-ray input window of the vacuum vessel, while another end portion of said support frame is vacuum-tightly joined to a peripheral portion of the vacuum vessel.

* * * * *